US006164115A

United States Patent [19]

Higuchi et al.

[11] Patent Number: 6,164,115

[45] Date of Patent: Dec. 26, 2000

[54] CAM SLIDER AND A CAM UNIT USING THE SAME

[75] Inventors: Masahiro Higuchi; Toshiyuki Yarimizu; Shoji Nemoto; Masahiro Shibata, all of Tokyo, Japan

[73] Assignee: Sankyo Oilless Industry, Inc., Tokyo, Japan

[21] Appl. No.: 09/468,937

[22] Filed: Dec. 22, 1999

[51] Int. Cl.[7] ..... B21D 5/04; B26D 5/16

[52] U.S. Cl. ..... 72/452.9; 72/315; 83/588

[58] Field of Search ..... 72/452.9, 315; 83/588

[56] References Cited

U.S. PATENT DOCUMENTS

| | | | |
|---|---|---|---|
| 5,231,907 | 8/1993 | Matsuoka | 72/452.9 |
| 5,269,167 | 12/1993 | Gerhart | 72/452.9 |
| 5,487,296 | 1/1996 | Gerhart et al. | 72/452.9 |

*Primary Examiner*—David Jones
*Attorney, Agent, or Firm*—Arent Fox Kintner Plotkin & Kahn, PLLC

[57] ABSTRACT

Disclosed is an improved cam slider in a cam unit to be fixed to a stationary metal mold tool and a movable metal mold tool for machining a pressed product. The cam slider is equipped with a resilient member to allow the cam slider to return to its original position subsequent to the cam action and a counter member to the resilient member.

2 Claims, 5 Drawing Sheets

CAM SLIDER AND A CAM UNIT USING THE SAME

BACKGROUND OF THE INVENTION

1. Field of the Invention

The present invention relates generally to a horizontal, suspension or inclined cam unit, which can be combined with a set of metal mold tools as used for example, in bending selected edges or ends of a car body frame, and particularly to a cam slider to be used in such a cam unit.

2. Related Arts

A large-sized metal plate is formed into a desired car body shape by pressing the metal plate between a stationary metal mold tool and a movable metal mold tool both aligned vertically. Referring to FIG. 5, when it is desired that holes are made on selected sides of the pressed product or when it is desired that selected edges or ends of the pressed product are bent, a horizontal cam unit 1*a* is attached to the movable and stationary metal mold tools 20 and 24 to effect a required machining on the pressed product. The horizontal cam unit 1*a* comprises a cam drive 21 and a cam slider 22. The cam drive 21 has an oblique surface 21*a* formed on its end, and the cam slider 22 has an oblique surface 22*a*, also. The cam drive 21 is fixed to the upper movable metal mold tool 20, and the cam slider 22 is slidably fixed to the base 24 of the lower stationary metal mold tool with their oblique surfaces 21*a* and 22*a* laid on each other. The cam slider 22 has a machining tool 23 (for example, a drill) fixed to its vertical side.

In operation the movable metal mold tool 20 reciprocates up and down to move the cam slider 22 right and left, thereby performing a required machining on the side surface of the pressed product.

The cam slider 22 is spring-biased leftward all the time by a resilient body 26 such as a spring mounted to a guide pin 26, which is fixed to the stationary metal mold 24. Thus, the rising of the movable metal mold 20 and hence the cam drive 21 will permit the cam slider 22 to return to its original position.

Referring to FIGS. 6 and 7, a suspension cam unit comprises an upper cam holder 27, an intermediate cam slider 28 and a lower cam base 29, all of which are laid slidably on each other. The upper cam holder 27 is fixed to the upper movable metal mold tool, and can be raised and lowered vertically as indicated by a double-headed arrow S1. The raising and lowering of the upper cam holder 27 over the stroke S1 will cause the cam slider 28 to move different strokes S2 and S3 in predetermined directions as indicated by double-headed arrows S2 and S3. The lower cam base 29 is fixed to the stationary metal mold tool to allow the cam slider 28 to perform a required cam action.

In this example the cam holder 27 has a guide pin 31 fixed thereto whereas the cam slider 28 has a resilient member 30 contained in its recess. The resilient member 30 is supported by the guide pin 31 to apply a resilient force to the cam slider 28, thereby making the cam slider 28 to return to its original position after performing the required cam action.

As for the former horizontal cam unit of FIG. 5 the spring 26 is fitted on the spring guide pin 26*a* which is fixed to the base 24 of the stationary metal mold tool, and the spring 26 abuts the vertical side of the cam slide 22 to apply its resilient force to the cam slider 22.

When it is required that a machining tool is positioned horizontally (0 degrees) or at an inclined angle of 10 or 15 degrees to meet occasional demands dependent on the particular shapes of car bodies, the base 24 of the stationary metal mold tool needs to be so modified as to position the spring guide pin 26*a* and the spring 26 at an oblique angle as desired.

The base 24 is massive, and it costs much to make and store a number of massive objects each permitting a selected machining tool to be attached at a desired oblique angle. A large warehouse space is required for storing such massive articles. Also, it is necessary that guide pins 26*a* and springs 26 be kept in custody at a different place other than the warehouse in which the massive articles are stored. When used, a selected guide pin and associated spring need to be attached to the base 24 and the cam slider 22 in exactly correct positions. This requires a skillful and tedious work; if such resilient parts are fixed a minimum amount apart from the correct position, the cam slider cannot move smoothly.

The cam slider 22 has no resilient member equipped therewith for permitting it to automatically return to its original position, and therefore, such cam slider cannot be readily applied to a pressing metal mold tool for shaping car bodies or to any other inclined machining apparatus. Stated otherwise, such cam sliders are reserved for exclusive use, and therefore, they cannot be marketed as separate parts for non-exclusive use.

As for the latter suspension cam unit the cam holder 27 is designed to have a guide pin 31 fixed thereto, and therefore, the cam unit has same defects as described above.

SUMMARY OF THE INVENTION

One object of the present invention is to provide an improved cam unit which is free of such defects as described above.

To attain this object a cam slider in a cam unit to be fixed to a stationary metal mold tool and a movable metal mold tool for machining a pressed product, is improved according to the present invention in that the cam slider is equipped with a resilient member to allow the cam slider to return to its original position subsequent to the cam action and a counter member to the resilient member.

A cam unit to be fixed to a stationary metal mold tool and a movable metal mold tool for machining a pressed product, comprising a cam driver to be fixed to one of the metal mold tools, a cam slider laid on the cam driver to be driven in a predetermined direction by the cam driver, and a cam holder laid on the cam slider to be fixed to the other metal mold tool, is improved according to the present invention in that the cam slider is equipped with a resilient member to allow the cam slider to return to its original position subsequent to the cam action and a counter member to the resilient member.

Thanks to its versatility a cam slider according to the present invention can be marketed as a separate part for non-exclusive use. The cam slider can be easily fixed to associated parts with bolts, provided that they have inclined surfaces to fit the cam slider, and that they have tapped holes for mounting the cam slider with bolts. A cam unit according to the present invention can be readily fixed to stationary and movable metal mold tools with bolts, provided that such metal mold tools have tapped holes for mounting the cam unit with bolts.

The cam slider is laid between the lower cam driver and the upper cam holder, and it suffices that these cam driver and cam holder are so made as to have oblique surfaces inclined to give a desired machining angle to the cam slider, and that holes are made in the cam driver and the cam holder for bolting to the upper movable and lower stationary metal mold tools, thus requiring no precision machining work in producing such parts. Therefore, these parts can be ordered to be made by outsider manufacturers.

This permits division of work, permitting separate parts to be made efficiently by different specialized workers. The cam holder has no guide pins for coiled springs and associated attachments, and accordingly it is simple in shape, small in size, and convenient for warehousing.

Other objects and advantages of the present invention will be understood from the following description of a cam unit according to one preferred embodiment of the present invention, which is shown in accompanying drawings.

DETAILED DESCRIPTION OF PREFERRED EMBODIMENT

Figure 1:
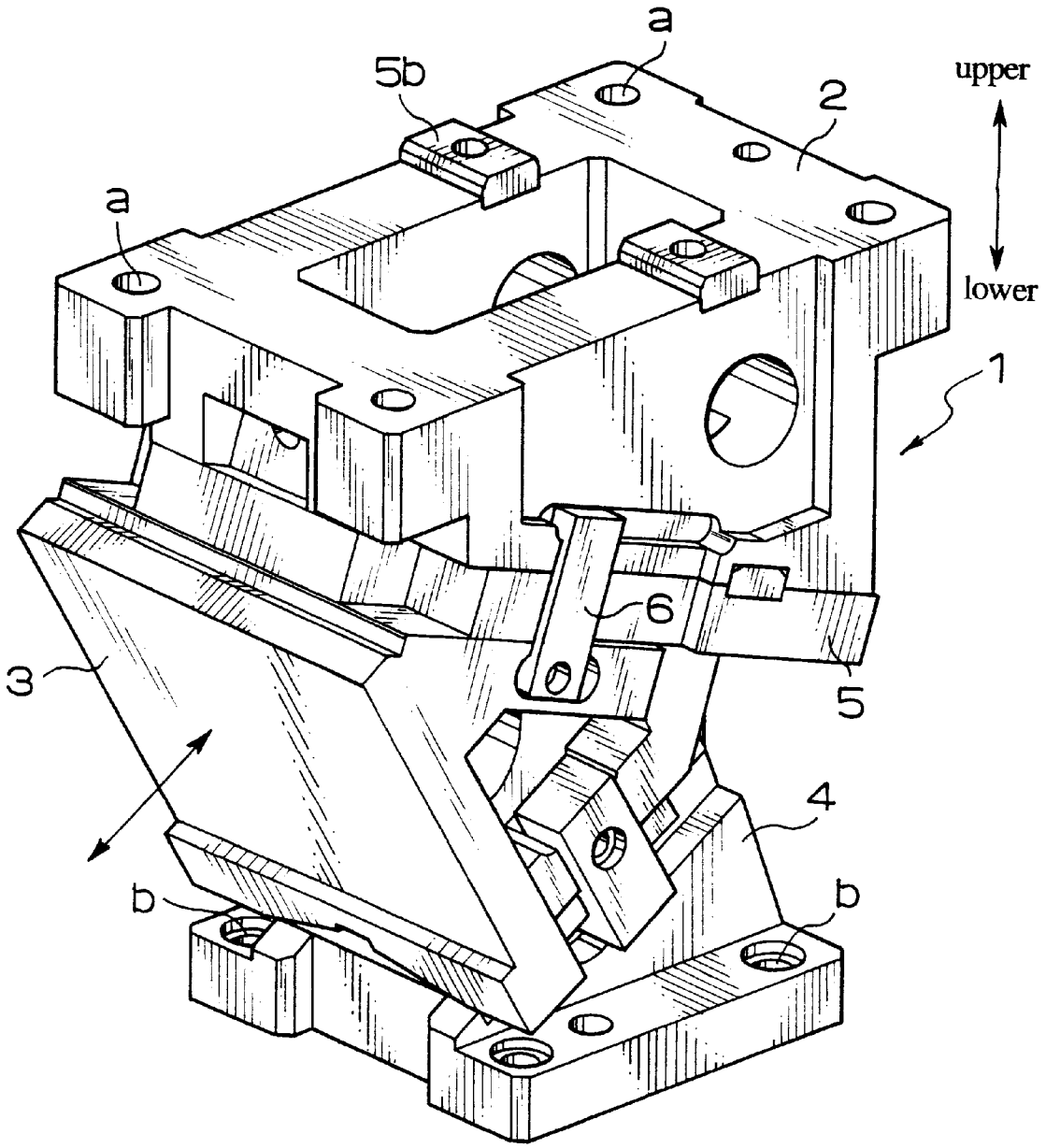
FIG. 1 is a perspective view of a cam unit according to the present invention.
Figure 2:
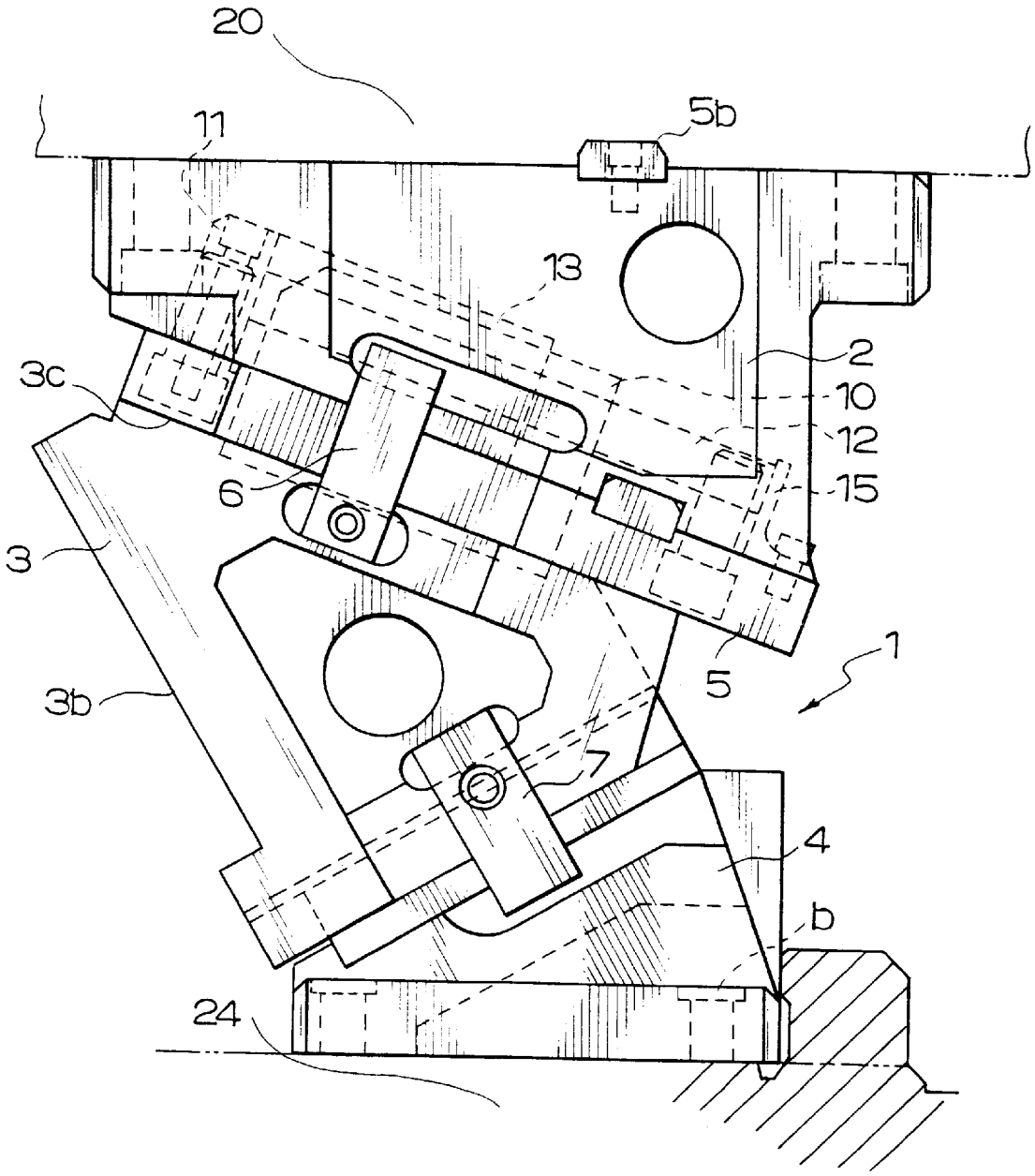
FIG. 2 is a front view of the cam unit.

Referring to FIGS. 1 and 2, a cam unit 1 which is to be fixed to a stationary metal mold tool 24 and a movable metal mold tool 20 for machining a pressed product, comprises a cam driver 4 to be fixed to the stationary metal mold tool 24, a cam slider 3 obliquely laid on the cam driver 4 to be driven in a predetermined direction by the cam driver 4, and a cam holder 2 laid on the cam slider 3 to be fixed to the movable metal mold tool 20.

As seen from FIG. 1, a base plate 5 is slidably sandwiched between the cam slider 3 and the cam holder 2. Specifically the base plate 5 is slidably mounted to the cam slider 3, and the base plate 5 is bolted to the cam holder 2 when the cam unit 1 is bolted to the stationary and movable metal mold tools 24 and 20.

The cam holder 2 is fixed to the upper movable metal mold tool 20 by inserting bolts in holes "a", and the cam driver 4 is fixed to the lower stationary metal mold tool 24 by inserting bolts in holes "b".

Figure 3:
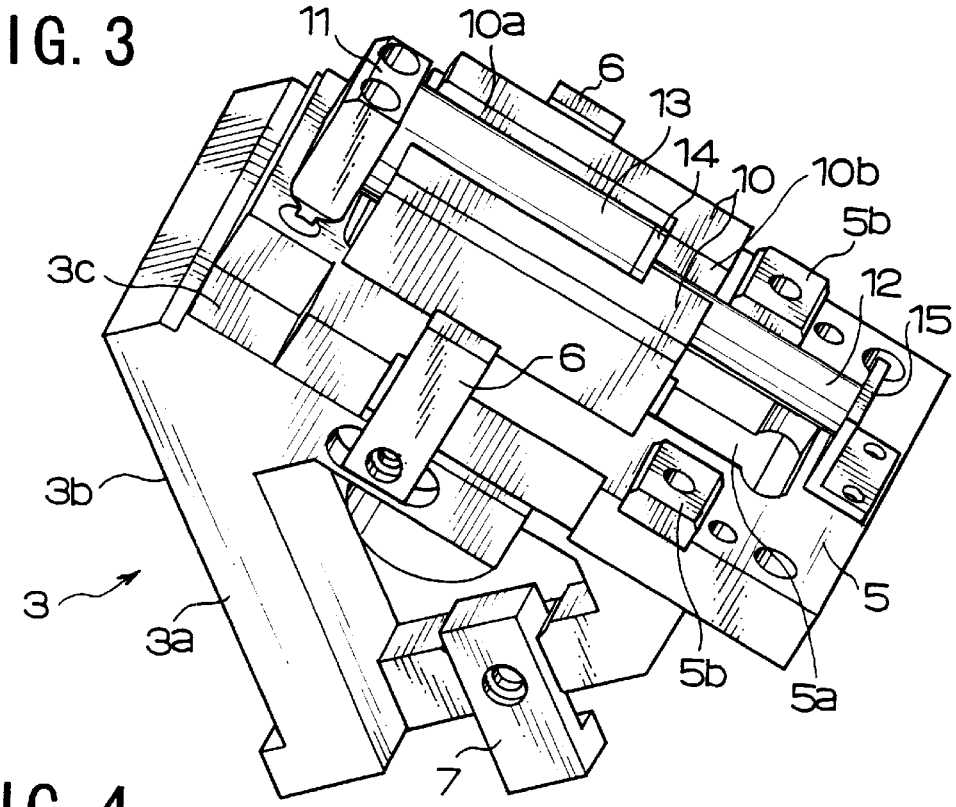
FIG. 3 is a perspective view of the cam slider.
Figure 4:
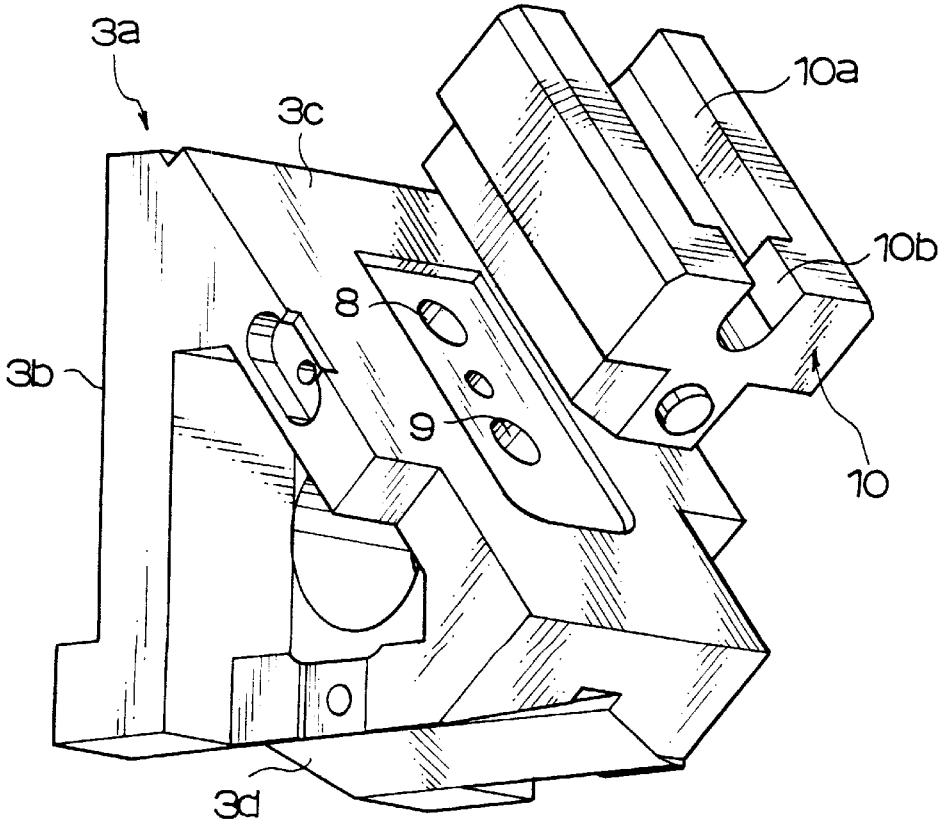
FIG. 4 is a perspective view of the cam slider, showing that the spring guide is apart from the cam slider.
Figure 5:
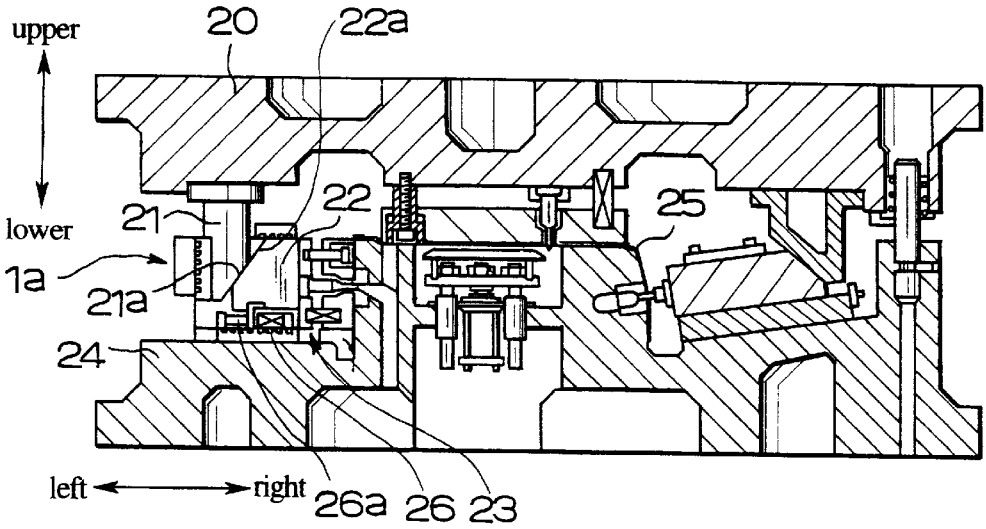
FIG. 5 PRIOR ART
FIG. 5 illustrates, in section, a conventional horizontal cam unit in the state of being used.
Figure 6:
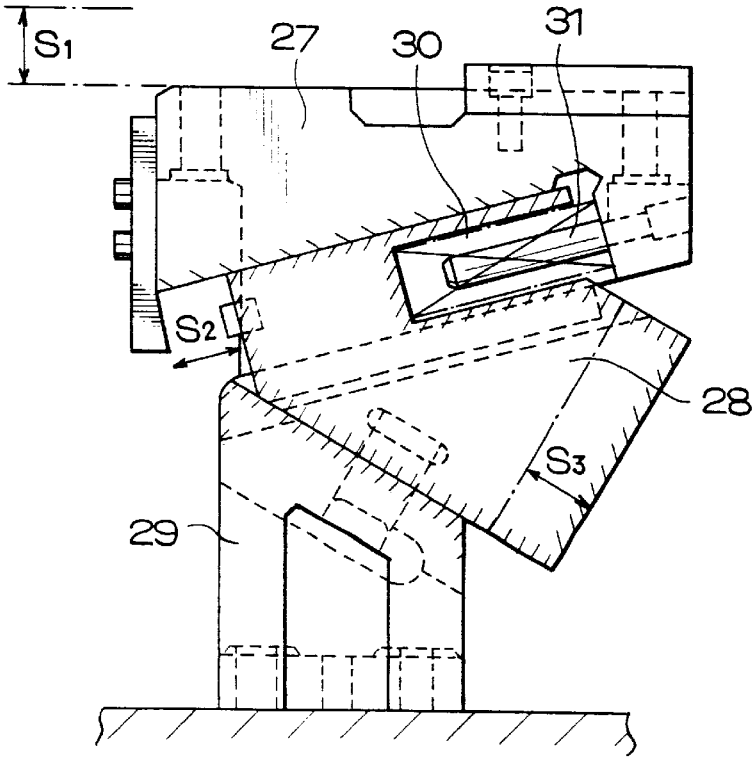
FIG. 6 PRIOR ART
FIG. 6 is a front view of a conventional suspension cam unit.
Figure 7:
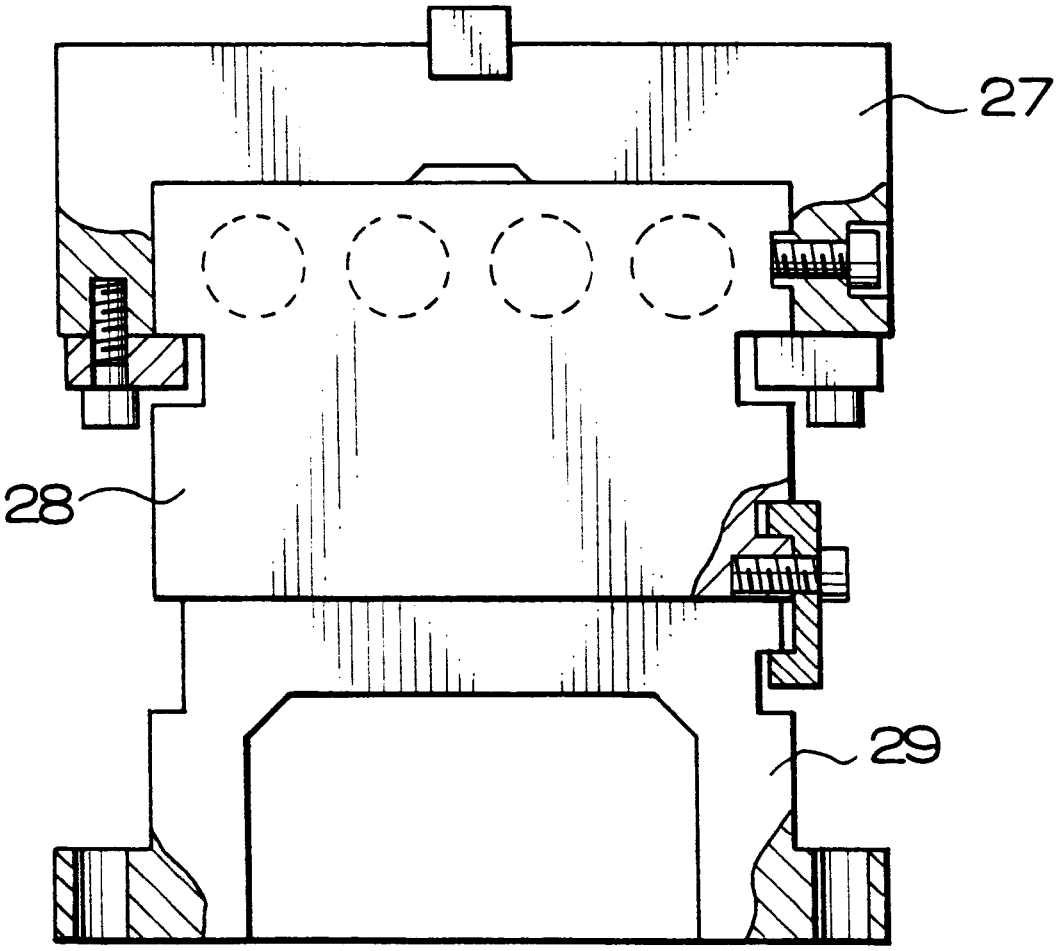
FIG. 7 PRIOR ART
FIG. 7 is a side view of the conventional suspension cam unit.

Referring to FIGS. 3 and 4, the slider body 3*a* has a "V"-shaped slide surface 3*d* formed on its bottom side (see FIG. 4), on which the slider body 3*a* can slidably move on the underlying cam drive 4. Also, the slider body 3*a* has a tool-attaching surface on its front side, and the bottom surface of the base plate 5 is slidably laid on the top surface 3*c* of the slider body 3*a*.

The slider body 3*a* has forcedly returning followers 6 and 7 bolted to its opposite sides, thereby jerking the cam slider 3 toward the original position subsequent to the cam action.

As seen from FIG. 4, the top surface 3*c* of the slider body 3*a* has holes 8 and 9 made in its center area for bolting a spring guide 10.

The cam slider 3 can be assembled by: putting the base plate 5 on the top surface 3*c* of the slider body 3*a*; inserting the longitudinal projection of the spring guide 10 in the center, longitudinal hole 5*a* of the base plate 5 until the longitudinal projection of the spring guide 10 has been put on the top surface 3*c* of the slider body 3*a*; and inserting bolts in the tapped holes 8 and 9 to fasten the spring guide 10 to the slider body 3*a*.

Thus, the base plate 5 is sandwiched between the top surface 3*c* of the slider body 3*a* and the spring guide 10, so that the base plate 5 is permitted to move slidably on the top surface 3*c* of the slider body 3*a*.

An upright guide pin block 11 is bolted to the front (left in FIG. 4) end of the base plate 5. One end of a guide pin rod 12 abuts on the guide pin block 11.

A spring 13 and an annular washer 14 are attached to the guide rod 12, and these are fitted in the inner cavity 10*a* of the spring guide 10. The washer 14 is pushed against the inner wall of the "U"-shaped slot 10*b* of the spring guide 10.

The guide pin rod 12 extends through the U-shaped slot 10*b* of the spring guide 10, and the other end of the guide pin rod 12 abuts on an L-shaped piece 15, which is bolted to the top surface of the base plate 5. Finally the forcedly returning followers 6 and 7 are bolted to the opposite sides of the slider body 3*a*.

The cam slider 3 thus assembled permits the slider body 3*a* to return to its original position by the spring 13, which exerts a pushing force to the slider body 3*a* via the spring guide 10 and washer 14 as a counter action to the guide pin block 11.

As is apparent from the above, the cam slider 3 is equipped with the spring 13, which permits the cam slider body 3*a* to return to its original position subsequent to the cam action. The base plate 5 and guide pin block 11 as a counter part to the spring 13 is provided in the cam slider 3, and therefore, the so designed cam slider 3 can be handled as a separate, independent article to be stored and marketed.

The cam holder 2 and the cam drive 4 can be easily combined with the cam slider 3 simply by using bolts to provide a complete cam unit 1 as shown in FIG. 1. All of the spring guide 10, guide pin block 11, guide pin rod 12, spring 13 and retainer piece 15 are confined within the inner cavity of the cam holder 2, and the bottom surface of the cam holder 2 is laid on the top surface of the base plate 5 in exact registration with the aid of square projections 5*b* (see FIG. 3).

Cam holders 2 and cam drives 4 are made to have different oblique sides to meet occasional demands for different machining angles say 5, 10 or 20 degrees and for fitting on different types of metal mold tools.

Thus, a cam unit 1 can be built to be most appropriate for use in the metal mold tool combination by selecting appropriate ones among those different cam holders 2, cam drives 4 and cam sliders 3 and by bolting the so selected cam slider 3 to the so selected cam holder 2 and cam drive 4. Then, the so built cam unit 1 is set on the upper movable and lower stationary mold tools 20 and 24. The rising and lowering of the movable metal mold tool 20 causes the machining tool-bearing slider body 3*a* to move in a predetermined direction to effect a required machining on a semi-fabricated product. The rising of the movable metal mold tool permits the slider body 3*a* to return to its original position.

The cam slider 3 described above includes the return spring 13, the counter base plate 5, the spring guide 10 and the guide pin block 11 along with associated parts, such as the guide pin rod 12 and the retainer piece 15. The spring guide 10, the guide pin block 11, the retainer piece 15 and other parts may be modified or replaced by some appropriate equivalents.

The cam slider is described as being used in a suspension cam unit, but it can be equally used in a horizontal or inclined cam unit.

What is claimed is:

1. A cam slider used as a component of a cam unit having a cam holder and a cam driver to be fixed to a stationary metal mold tool and a movable metal mold tool for machining a pressed product, comprising a slider body, a resilient member for allowing the cam slider to return to its original position subsequent to the cam action, a counter member to the resilient member, and a base plate bolted to the cam holder and sandwiched between a top surface of the slider body and the resilient member such that the base plate is slidably movable on the top surface of the slider body.

2. A cam unit to be fixed to a stationary metal mold tool and a movable metal mold tool for machining a pressed product, comprising a cam driver to be fixed to one of the metal mold tools, a cam slider laid on the cam driver to be driven in a predetermined direction by the cam driver, and a cam holder laid on the cam slider to be fixed to the other metal mold tool, wherein the cam slider comprises a slider body, a resilient member for allowing the cam slider to return to its original position subsequent to the cam action, a counter member to the resilient member, and a base plate bolted to the cam holder and sandwiched between a top surface of the slider body and the resilient member such that the base plate is slidably movable on the top surface of the slider body.

* * * * *

US006164115C1

(12) EX PARTE REEXAMINATION CERTIFICATE (7497th)

United States Patent
Higuchi et al.

(10) Number: US 6,164,115 C1
(45) Certificate Issued: May 11, 2010

(54) CAM SLIDER AND A CAM UNIT USING THE SAME

(75) Inventors: Masahiro Higuchi, Tokyo (JP); Toshiyuki Yarimizu, Tokyo (JP); Shoji Nemoto, Tokyo (JP); Masahiro Shibata, Tokyo (JP)

(73) Assignee: Sankyo Oilless Industry, Inc., Fuchu-Shi, Tokyo (JP)

Reexamination Request:
No. 90/009,256, Aug. 14, 2008

Reexamination Certificate for:

| | |
|---|---|
| Patent No.: | **6,164,115** |
| Issued: | **Dec. 26, 2000** |
| Appl. No.: | **09/468,937** |
| Filed: | **Dec. 22, 1999** |

(51) Int. Cl.
*B21D 5/04* (2006.01)
*B26D 5/16* (2006.01)

(52) U.S. Cl. ..... 74/452.9; 74/315; 74/588

(58) Field of Classification Search ..... 72/452.9, 72/315; 83/588
See application file for complete search history.

(56) References Cited

U.S. PATENT DOCUMENTS

| | | | |
|---|---|---|---|
| 5,269,167 | A | 12/1993 | Gerhart |
| 5,487,296 | A | 1/1996 | Gerhart et al. |
| 6,250,177 | B1 | 6/2001 | Sasahara |

FOREIGN PATENT DOCUMENTS

| | | |
|---|---|---|
| JP | 2000-061764 | 2/2000 |

OTHER PUBLICATIONS

Oiles Corporation Catalog Entitled, "Oiles Standard Components Die & Jig '96–'97", 302 pages.

*Primary Examiner*—Matthew C. Graham

(57) ABSTRACT

Disclosed is an improved cam slider in a cam unit to be fixed to a stationary metal mold tool and a movable metal mold tool for machining a pressed product. The cam slider is equipped with a resilient member to allow the cam slider to return to its original position subsequent to the cam action and a counter member to the resilient member.

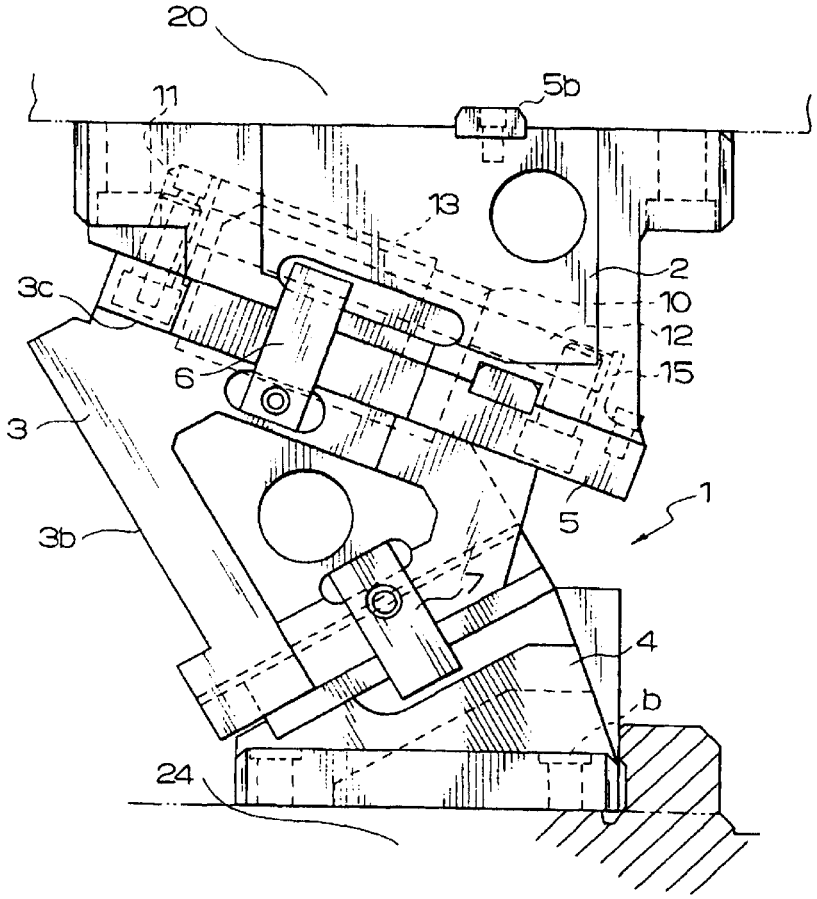

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 2 are determined to be patentable as amended.

New claims 3–24 are added and detemined to be patentable.

1. A cam slider used as a component of a cam unit having a cam holder and a cam driver to be fixed to a stationary metal mold tool and a movable metal mold tool for machining a pressed product, comprising a slider body, a resilient member for allowing the cam slider to return to its original position subsequent to the cam action, a counter member to *provide a counter support that supports* the resilient member, and a base plate bolted to the cam holder and sandwiched between a top surface of the slider body and the resilient member such that the base plate is slidably movable on the top surface of the slider body, *wherein the counter member is fixed on the base plate such that the resilient member is supported by the counter member to urge the slider body toward its original position*.

2. A cam unit to be fixed to a stationary metal mold tool and a movable metal mold tool for machining a pressed product, comprising a cam driver to be fixed to one of the metal mold tools, a cam slider laid on the cam driver to be driven in a predetermined direction by the cam driver, and a cam holder laid on the cam slider to be fixed to the other metal mold tool, wherein the cam slider comprises a slider body, a resilient member for allowing the cam slider to return to its original position subsequent to the cam action, a counter member to *provide a counter support that supports* the resilient member, and a base plate bolted to the cam holder and sandwiched between a top surface of the slider body and the resilient member such that the base plate is slidably movable on the top surface of the slider body, *wherein the counter member is fixed on the base plate such that the resilient member is supported by the counter member to urge the slider body toward its original position*.

*3. The cam slider according to claim 1, further comprising a guide pin rod having opposite ends fixed to the base plate, the resilient member comprising a spring supported on the guide pin rod.*

*4. The cam slider according to claim 3, further comprising a spring guide fixed to the slider body and having an inner cavity in which the guide pin rod and the spring are received.*

*5. The cam slider according to claim 4, wherein the spring, supported by the counter member, acts against the spring guide to urge the slider body in a direction to return the cam slider to its original position subsequent to the cam action.*

*6. The cam slider according to claim 5, wherein the counter member is bolted directly to the base plate.*

*7. The cam slider according to claim 4, wherein the counter member is bolted directly to the base plate.*

*8. The cam slider according to claim 3, wherein the counter member is bolted directly to the base plate.*

*9. The cam slider according to claim 1, wherein the counter member is bolted directly to the base plate.*

*10. The cam slider according to claim 1, further comprising a spring guide fixed to the slider body and having an inner cavity in which the resilient member, which comprises a spring, is received.*

*11. The cam slider according to claim 10, wherein the spring, supported by the counter member, acts against the spring guide to urge the slider body in a direction to return the cam slider to its original position subsequent to the cam action.*

*12. The cam slider according to claim 11, wherein the counter member is bolted directly to the base plate.*

*13. The cam slider according to claim 10, wherein the counter member is bolted directly to the base plate.*

*14. The cam unit according to claim 2, wherein the cam slider further comprises a guide pin rod having opposite ends fixed to the base plate, the resilient member comprising a spring supported on the guide pin rod.*

*15. The cam unit according to claim 14, wherein the cam slider further comprises a spring guide fixed to the slider body and having an inner cavity in which the guide pin rod and the spring are received.*

*16. The cam unit according to claim 15, wherein the spring, supported by the counter member, acts against the spring guide to urge the slider body in a direction to return the cam slider to its original position subsequent to the cam action.*

*17. The cam unit according to claim 16, wherein the counter member is bolted directly to the base plate.*

*18. The cam unit according to claim 15, wherein the counter member is bolted directly to the base plate.*

*19. The cam unit according to claim 14, wherein the counter member is bolted directly to the base plate.*

*20. The cam unit according to claim 2, wherein the counter member is bolted directly to the base plate.*

*21. The cam unit according to claim 2, wherein the cam slider further comprises a spring guide fixed to the slider body and having an inner cavity in which the resilient member, which comprises a spring, is received.*

*22. The cam unit according to claim 21, wherein the spring, supported by the counter member, acts against the spring guide to urge the slider body in a direction to return the cam slider to its original position subsequent to the cam action.*

*23. The cam unit according to claim 22, wherein the counter member is bolted directly to the base plate.*

*24. The cam unit according to claim 21, wherein the counter member is bolted directly to the base plate.*

* * * * *